United States Patent [19]

Miller

[11] 3,930,491

[45] Jan. 6, 1976

[54] COMBINATION FIREPLACE AND SPACE HEATER

[75] Inventor: Robert B. Miller, Stamford, Conn.

[73] Assignee: Raymond Lee Organization Inc., New York, N.Y. ; a part interest

[22] Filed: Jan. 6, 1975

[21] Appl. No.: 538,515

[52] U.S. Cl. ..... 126/121; 237/51

[51] Int. Cl.[2] ..... F24B 7/00

[58] Field of Search ..... 126/121; 237/51; D7/207

[56] References Cited

UNITED STATES PATENTS 1,571,741 2/1926 Smith ..... 126/121

2,359,197 9/1944 Brooks ..... 126/121

*Primary Examiner*—William F. O'Dea

*Assistant Examiner*—Ronald C. Capossela

[57] ABSTRACT

A conventional fireplace with a mantel, a hearth and a chimney has an air intake port and an air exhaust port disposed in the mantel. An air intake fan also disposed in the mantel is connected in series with copper pipe, and the fan is connected to the intake port while the remote end of the pipe feeds the exhaust port. The pipe is routed over the hearth and below the chimney. When a fire is lit in the fireplace, and the fan is turned on, the air passed through the pipe is heated by the fire and blown throughout the room.

2 Claims, 3 Drawing Figures

COMBINATION FIREPLACE AND SPACE HEATER

SUMMARY OF THE INVENTION

The invention is directed towards more efficiently utilizing the heat produced in a conventional fireplace with a hearth for containing the fire, a mantel and a chimney.

In this invention, an air intake port and an air exhaust port are placed in the mantel of the fireplace. An intake fan sucks air into the intake port, and routes it through a pipe to the exhaust port. The pipe is routed over the hearth of the fireplace and below the chimney and is heated by any fire that is set in the hearth, thus heating any air blown through the pipe by the fan.

Thus, a space heater is formed that heats the room in which the invention is disposed. In conventional fireplaces, most of the heat produced leaves the room to be heated via the chimney, and in the present device, this heat is used to heat the room, resulting in an increase in heating efficiency.

DETAILED DESCRIPTION OF PREFERRED EMBODIMENTS

Figure 1:
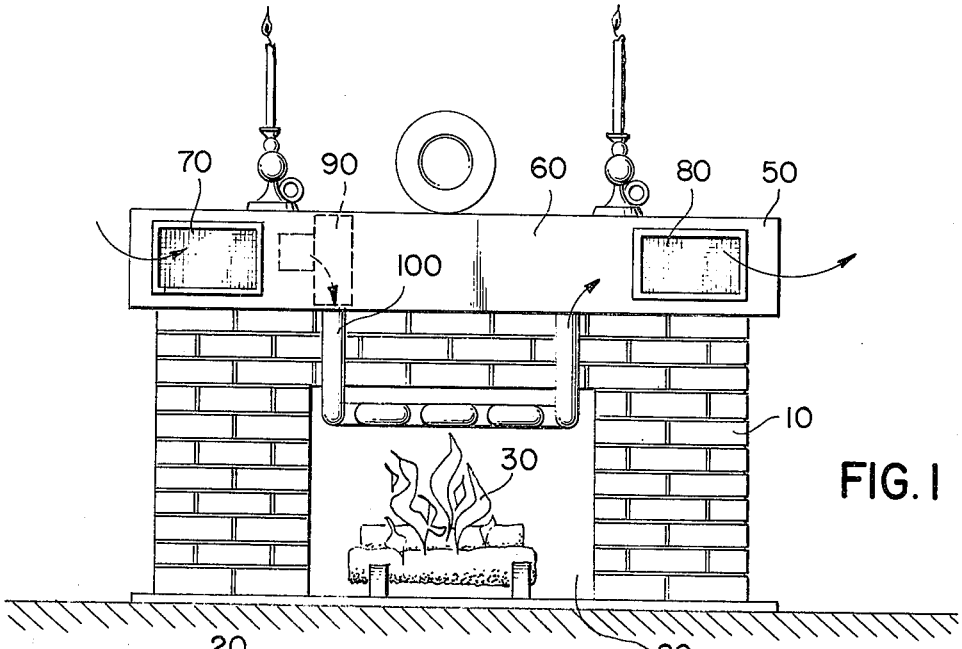
FIG. 1 is a front view of the invention in use.
Figure 2:
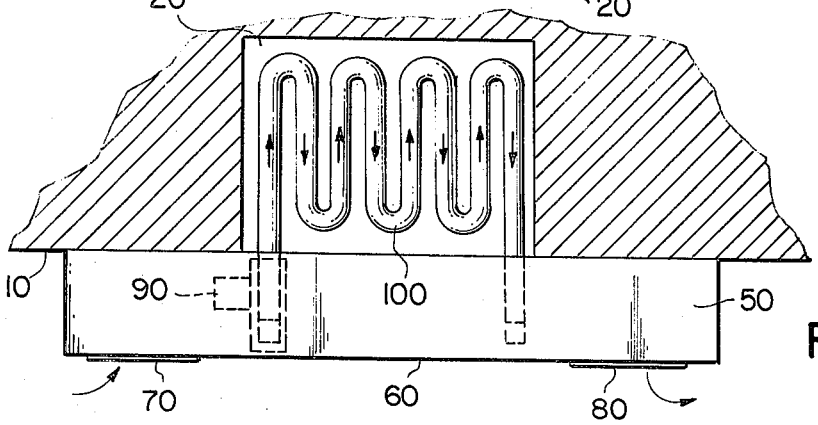
FIG. 2 is a top view of the invention.
Figure 3:
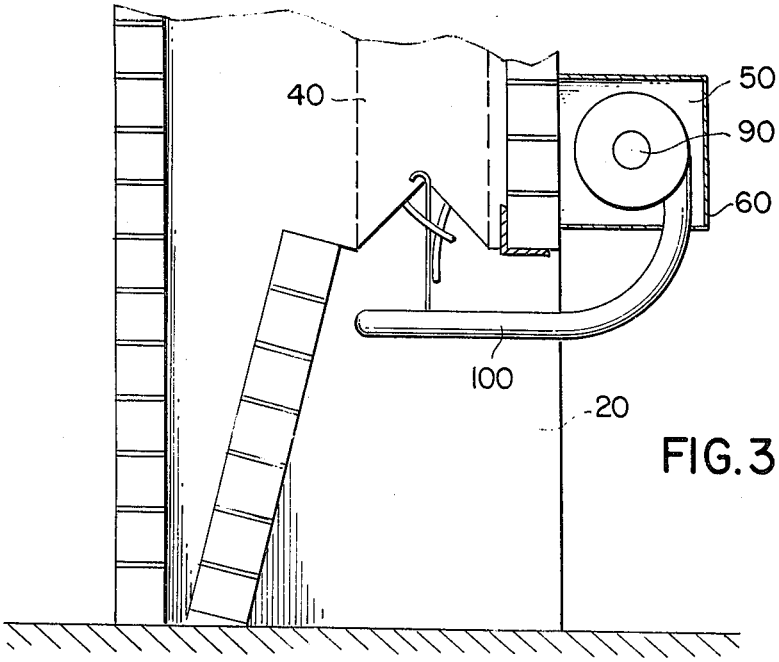
FIG. 3 is a side cross-section of the invention.

A conventional fireplace has a brick front 10 that surrounds the back and sides of a hearth 20 in which a fire 30 may be lit. The hearth has an open front, and is surmounted by a chimney 40 into which hot gases and ashes can rise when a fire is lit. Disposed above and forward of the brick front is a hollow mantel 50 taking the form of an elongated rectangular parallelepiped. At opposite end of the front surface 60 of the mantel are disposed an air intake port 70 and a like air exhaust port 80. An intake fan 90 disposed in the mantel blocks off the interior of the mantel into two sections, one for each port, and sucks air into the intake port when energized. The air is then directed into copper pipe 100, which extends downwardly and rearwardly from the fan, out of the mantel, and is then looped backwardly and forwardly in a horizontal plane between the hearth and the chimney. After passing between the hearth and the chimney, the pipe rises upwardly and forwardly to feed into the section of the mantel behind the exhaust port.

Thus, the fan can suck cool air into the intake port and can direct it into the pipe, where the air can be heated by the fire. The heated air will then pass out the exhaust port to heat the room in which the fireplace is disposed. The heated air is not contaminated by waste gases and partially burned particles produced by the fire.

While the invention has been described with detailed reference to the drawings, the protection sought is to be limited only by the terms of the claims which follow.

I claim:

1. A combination fireplace and space heater comprising:

a fireplace having a top disposed elongated horizontal hollow mantel, a hearth disposed below and to the rear of said mantel, said hearth having an open front with closed bottom, closed sides and top, and a chimney communicating with the hearth and rising upwards from the top, said mantel having a front disposed vertical air intake port at one end and a front disposed vertical air exhaust port at the other end;

an air intake fan disposed in the mantel to block off the interior of the mantel into one section communicating with the air intake port and a second section communicating with the air exhaust port, said fan drawing air inward through the intake port and discharging air;

a thermally conductive hollow pipe secured at one end to said fan and receiving said discharged air, said pipe extending rearwardly from the fan and downwardly from the mantel into the hearth, then looping backwardly and forwardly in a horizontal plane below the top of the hearth, then rising upwardly and forwardly into the second section of the mantel to convey the discharged air via the opposite open end of the pipe into the second section and out of the exhaust port, said air being heated while in the pipe when a fire burns in the hearth.

2. The device of claim 1 wherein said pipe is made of copper.

* * * * *